United States Patent [19]

McMullan

[11] 4,243,336

[45] Jan. 6, 1981

[54] CONSUMABLE PACKAGE WITH COLLAPSIBLE HANDLE

[75] Inventor: Robert G. McMullan, Oakville, Canada

[73] Assignee: SCM (Canada) Limited, Don Mills, Canada

[21] Appl. No.: 10,389

[22] Filed: Feb. 8, 1979

[51] Int. Cl.[3] ..... A46B 5/02; B43K 19/14

[52] U.S. Cl. ..... 401/6; 401/97; 229/52 B

[58] Field of Search ..... 401/97, 96, 91, 88, 401/49; 426/110, 112, 115, 122, 123, 124, 130, 134, 394; 206/602, 606, 627, 526, 527; 229/52 A, 52 B, 37–39, 43; 16/110 R

[56] References Cited

U.S. PATENT DOCUMENTS

| | | | |
|---|---|---|---|
| 1,492,100 | 4/1924 | Krueger | 229/52 A |
| 1,532,766 | 4/1925 | Levy | 401/97 |
| 1,624,439 | 4/1927 | Senat | 229/52 B |
| 3,539,093 | 11/1970 | Massengill | 206/606 |
| 3,967,773 | 7/1976 | Kaufmann | 206/606 |
| 4,062,487 | 12/1977 | Bliss | 229/52 B |
| 4,073,950 | 2/1978 | Hansen et al. | 426/122 X |

*Primary Examiner*—Robert W. Michell
*Assistant Examiner*—Jeffrey W. Tayon
*Attorney, Agent, or Firm*—A. J. Gibbons

[57] ABSTRACT

A consumable rectangular package with tear-away strips and collapsible handle is a useful container/applicator for solid paints, coatings, adhesives and other dimensionally stable gel-type materials. Such applicators are advantageous in that they allow painting without conventional brushes, rollers and similar conventional implements and are readily disposable.

3 Claims, 7 Drawing Figures

CONSUMABLE PACKAGE WITH COLLAPSIBLE HANDLE

BACKGROUND OF THE INVENTION

Within the last few years new non-conventional types of paint products having dimensional stability based on ion-bonding and ion particle bonding were developed. These new products, called Solid Paints, differed considerably from conventional paints of the prior art in that unique gel properties resulted from cross-linking of certain reactive polymers with "ion clusters" having polar molecule components. Such Solid Paints having non-volatile contents on the order of 45–85 weight-percent and gel strengths on the order of 75–175 mm of penetration as measured by a Universal Penetrometer are exemplified in U.S. Pat. Nos. 3,994,849; 3,994,848; and 4,078,116.

Because of the unusual properties of these solid (gel) paints, conventional application tools were not useful. A need thus arose for a suitable container to house the new solid paint product which would allow the convenient application of these coatings to various substrates. This invention relates to a container/applicator package for dimensionally stable solid paints and related materials having high gel strengths. Products of this nature and containers therefor have not heretofore been known.

BRIEF SUMMARY OF THE INVENTION

One object of the present invention is to provide a disposable rectangular or square container/applicator for solid paint useful for painting or coating of various substrates.

A primary object is to provide a container/applicator package for storing and applying dimensionally stable solid materials deformable on contact with a surface on which said material may be deposited as a coating or treatment which comprises:

(a) an assembled outer shell formed from a one-cut unfolded package as depicted in FIG. 1 and having one or more individually horizontally positioned removable tear strips whereby the dimensionally stable and deformable solid material may be exposed for application to a substrate;

(b) an inner lining firmly bonded to the outer shell and functions as a barrier to contain the solid deformable material and to prevent diffusion of air into the package which would undesirably lead to oxidation and the formation of paint skins;

(c) a collapsible handle attached to the shell portion which allows said package containing the deformable solid material to be conveniently grasped in the hand for manual application of the solid material to a substrate; said handle consisting of a die-cut main body which can be folded down in accordion fashion and a flap section, fastened to the inside of the main body which can be pushed inward to form a V-base which stabilizes the handle in the open position.

Further objects include applicators of the above type wherein the dimensionally stable deformable solid material is a solid paint, a solid adhesive, a caulking compound, sealant and other deformable materials having gel strengths on the order of 75 to 250 mm of penetration on a Universal Penetrometer.

DETAILED DESCRIPTION OF THE INVENTION

The container/applicator of the present invention represents a major advancement in the paint and coating art and was developed primarily to accommodate a new concept in paints, i.e. solid paints, as exemplified in U.S. Pat. Nos. 3,994,848; 3,994,849; 4,078,116; and Ser. No. 725,633 filed Sept. 22, 1976. These solid paints are self supporting and exhibit gel strengths of about 75–175 mm penetration as measured on a Universal Penetrometer. They can be mold formed in various shapes and sizes.

The consumable rectangular package with tear-away strips and collapsible handle is made from standard card material approximately 0.010" to 0.030" thick, preferably about 0.020" thickness, with a foil laminate inside surface which can be peeled away at specific intervals to expose the product as required. The tear-away strips, which are one unique feature of the package, are accomplished by the method of die cutting allowing the material to be peeled away leaving a clean sharp edge. The card is die cut halfway through the thickness on one side and then turned over and die cut halfway through again. This second die cut operation is spaced approximately 3/32" away from the previous cut. This maintains a physically strong piece of material but allows it to break away when pulled by the tabs which are designed into the package. The package is then formed in a conventional manner.

Since the package is completely consumed by the tearing away of the strips, this has created the need for a handle. The collapsible handle, shown in FIGS. 4, 5, 6 and 7 is an integral part of the container/applicator. The main feature of the package is that it is a controlled disposable container which is rectangular or square in shape. The combining of both these features (the tear-away strip-collapsible handle) makes this a very inexpensive and practical way of dispensing a dimensionally stable gel product including solid paints.

The instant invention is specifically exemplified by a detailed consideration of the various drawings.

Figure 1:
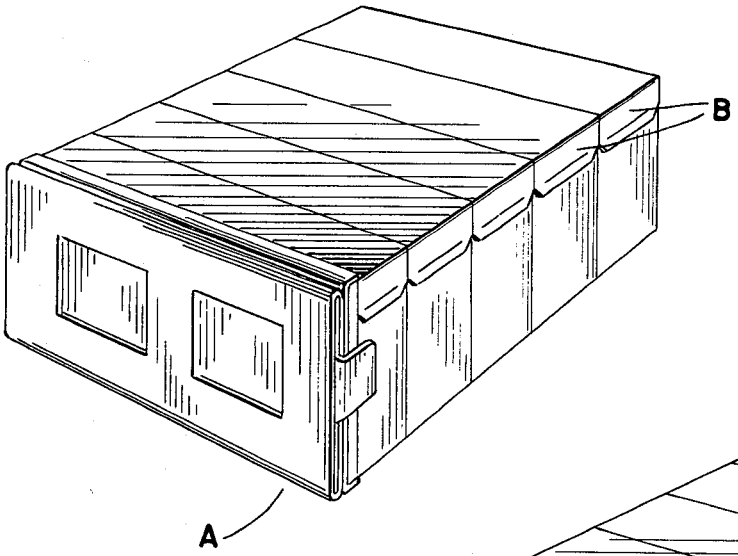
FIG. 1 is a perspective drawing of the tear-away package with the collapsible handle in the closed position.
Figure 2:
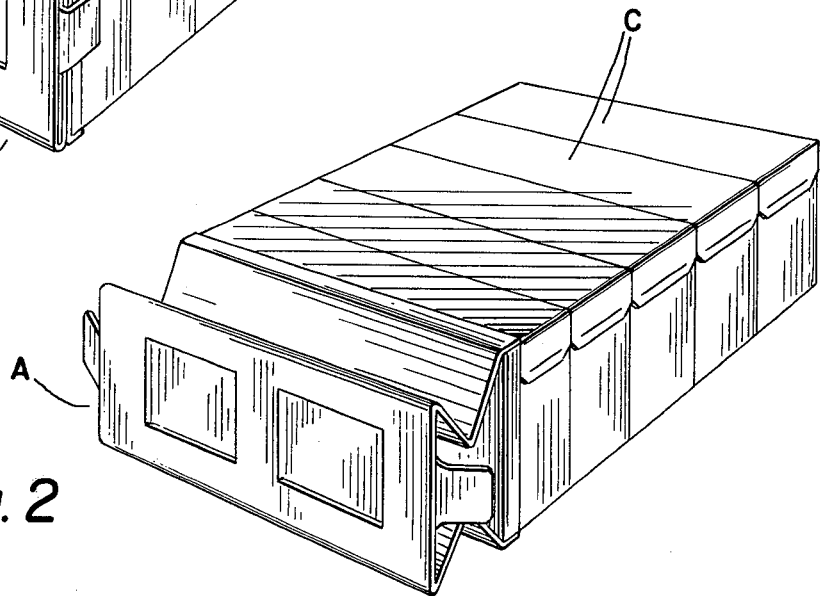
FIG. 2 is a perspective drawing of the consumable package with the collapsible handle in a partially open position.
Figure 3:
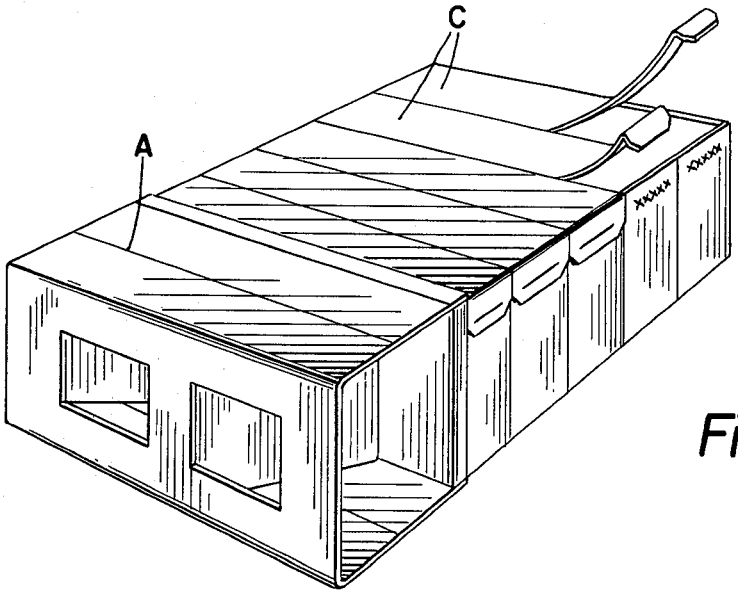
FIG. 3 is a perspective drawing of the container with the collapsible handle in the fully opened position and the top tear strips opened to expose the consumable gel material.
Figure 4:
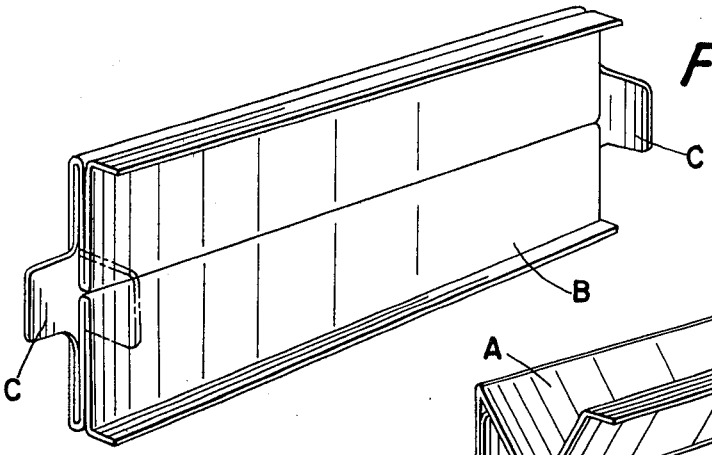
FIGS. 4, 5, 6 and 7 show perspective views of the handle in the closed, partially opened and fully opened positions.
Figure 5:
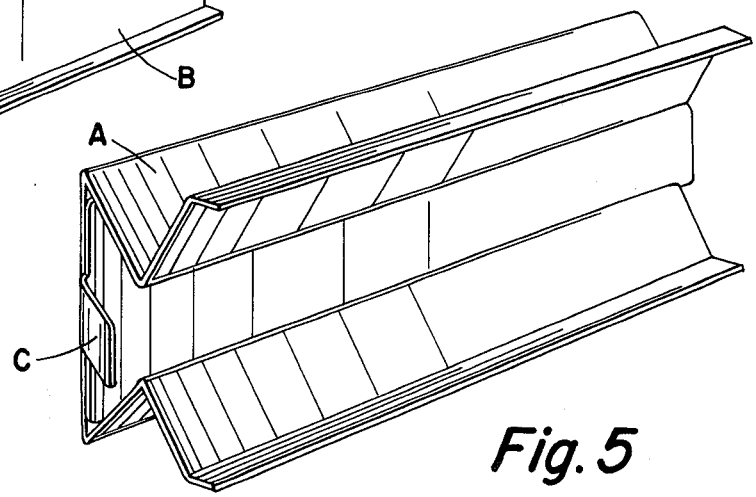
Figure 6:
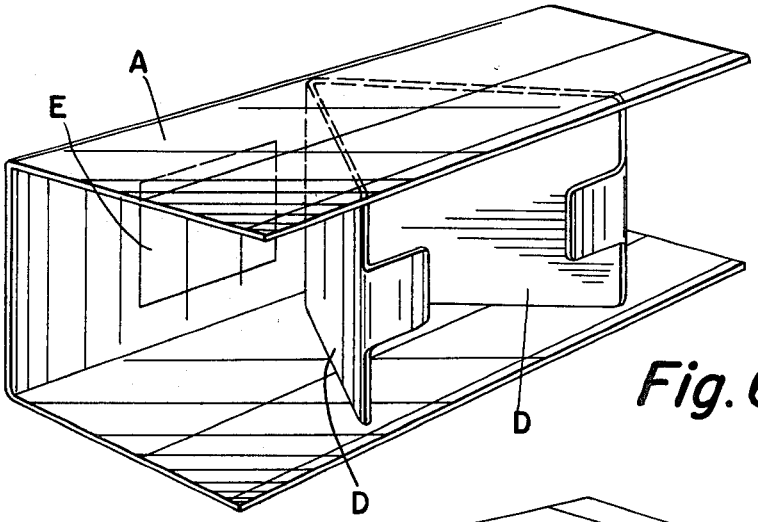
Figure 7:
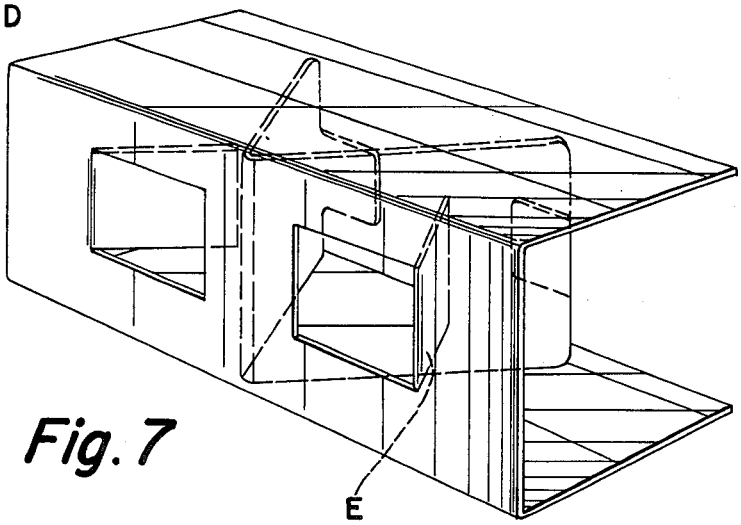

FIGS. 1, 2 and 3 present perspective views of the overall package having a top portion capable of containing the solid gel material and a collapsible handle (A) attached to the bottom thereof. Tear tab handles (B) allow the individual tear strips (C) to be removed sequentially for the purpose of exposing a useable quantity of solid paint or gel. Although the particular container depicted represents a solid paint volume content of approximately 150 cc, the container is readily manufactured in different useable sizes and the invention should not be limited to any one volume or dimension.

The shape of the tear handle (tab) can be varied so long as it is readily grasped to easily remove the tear strip. The shape depicted is particularly advantageous in this respect. In a similar fashion, the number of tear strips will be determined by the height and/or volume of the particular holder applicator.

Various materials may be utilized for the outside surface; 20 pt. cylinder board is particularly advantageous for the purposes of the instant invention. In the Figures, only the external die-cut lines are indicated. Additional die-cut lines displaced from and parallel to the external die-cut lines are made on the inside of the cardboard. The depth of the inside and outside die-cut lines is equal to one-half the thickness of the board. Prior to painting, the top tear strip is removed to expose a useable portion of the solid paint. The paint is then applied to the various substrates by holding the container in such fashion that the exposed paint surface is in contact with the substrate to be coated. Using a variety of hand movements, sufficient pressure is applied to deform the gel material in contact with the substrate whereby a coating is applied to the substrate. Just as in conventional painting, the thickness of the paint film depends on the number of times the solid paint is drawn across the surface and in part on the pressure exerted at the point of contact.

The collapsible handle is more fully illustrated in FIGS. 4, 5, 6 and 7. The handle is fabricated from two pieces of card material (approximately 24 gauge). The main body (A) is die cut and folded in such a manner as to allow it to fold down in an accordion fashion. The second part (B) is fastened to the inside of the main body at the centre. This part has two flaps (C), one at either end, which are fastened to the sides of the package holding the handle in the closed position until needed. To put the handle in the open position, the two side flaps (C) are released and the handle partially pops open. The second part (D) which folds from the inside centre is pushed in from both sides forming a V brace and stabilizes the handle in the open position. Two small tabs (E) which have been die cut into the base of the main body are pressed inward which prevents the V brace from moving out of position. The handle is now ready to use.

A particular advantageous function of the handle is that it allows the applicator to be firmly gripped and held in the hand of the person using said applicator in dispensing the contents to a substrate surface.

The solid material is preferably charged via the top end of the container which will then be sealed with a barrier seal prior to end closure. The barrier seals include a variety of plastic and metal foil materials either taken alone or in combination. The barrier end seals are advantageously heat sealable thermoplastics or laminates which serve to contain the solid paint and prevent air oxidation. Suitable barriers include laminates consisting of polyester/polyvinylidene chloride/polyethylene and the like. A plastic laminate consisting of nylon/polyvinylidene chloride/polyethylene and 0.0003 to 0.001 inch aluminum foil is especially preferred. The aluminum foil is advantageously sandwiched between layers of the plastic material. The end barriers are sealed to the package by conventional sealing techniques.

An advantageous inner lining consists of a 0.0008 inch aluminum foil barrier laminated to the outer paperboard shell via a thermosealing polycoat. The polycoat acts to thermally bond the foil layer to the cardboard material. Although numerous polycoat materials may be used, a polyethylene, extrusion coated to the paperboard, is preferred. Similar polycoats can also be used to heat seal the end flaps of the container. Please note that the off-set positions of the external and internal die-cuts in the cylinder board and the interposition of a poly interface between the outer cylinder board and the internal foil lining (barrier). In a preferred system, the die-cuts are made on the inner surface of the paperboard or cylinder board, the aluminum foil is then bonded to the inner surface and die-cuts are then made on the external surface of the paperboard. Suitable liners which make effective barriers include cellulosics, polycarbonates, polypropylene, polyester or metallized plastic sheet material. Aluminum foils of about 0.0003 to 0.001 inch thickness are especially preferred. The liner must have the ability to propagate a tear after nipping.

What I claim is:

1. A handle assembly for a generally rectangular box-like container-applicator for a solid gel paint or adhesive, said handle being disposed at one end of the container and being normally collapsed until the container is to be used, but being expandable so that it can be used as a means for gripping the container at one end thereof by said handle when applying paint or adhesive from the opposite end, said handle comprising in its expanded state, as assembled for use:

a generally U-shaped body of sheet material that has a base portion and two arms extending from the opposite sides of said base portion, each arm having a lip portion capable of being attached to the rectangular box-like container, and two support flaps extending from the base portion capable of engaging a rigidifying V-shaped internal support positioned within the U-shaped body, and a rigidifying V-shaped internal support disposed within said U-shaped body comprising a central hinge portion and two arms extending from said hinge portion at its opposite sides, said hinge portion being disposed against and secured substantially at the center of the inner face of the base portion of said U-shaped body and extending transversely of said base, the arms of said V-support extending toward the end face of said container and engaging against it, each arm of the V-support having a tab member at the end where the arm portion engages the container, said tab extending internally within the V-support and engaging the end face of said container to support the handle in its expanded state, opposite edges of both of said arms being engaged against the confronting inner faces of the arms of said U-shaped body, and the base of said U-shaped body being formed with a pair of flaps cut therefrom and hinged thereto, which flaps are projected toward said container, to engage the V-shaped support said flaps being disposed at opposite sides of the hinge portion of said rigidifying sheet respectively, and when projected from said base leaving a pair of openings in said base adapted to receive fingers therein, said handle in its collapsed state having said flaps seated in the openings in the base of the U-shaped body, the rigidifying sheet being flattened out and lying against the base portion of said U-shaped body, and the arms of said U-shaped body being accordian-folded, whereby the handle assembly has the appearance of flat sheets disposed at one end of said container.

2. The handle assembly of claim 1 wherein said rigidifying V-shaped support is formed with a pair of tab members at its opposite ends, which tab members are fastened to the container when the handle assembly is in its collapsed state, and which in the expanded state of the handle assembly are detached from the container and positioned internally against the end face of the container to permit expansion of the handle assembly and provide the internal rigidifying support.

3. An article of manufacture useful for the application of solid paint to a substrate which comprises a solid paint, a generally rectangular box-like container for containing said solid paint and an expandable handle according to claim 1, said handle being disposed at one end of the container.

* * * * *